United States Patent [19]

Wu

[11] 4,162,842

[45] Jul. 31, 1979

[54] METHOD AND APPARATUS FOR DEVELOPING A LATENT, ELECTROSTATIC IMAGE IN NON-IMPACT PRINTING

[75] Inventor: Alexander C. Wu, Plymouth, Mich.

[73] Assignee: Burroughs Corporation, Detroit, Mich.

[21] Appl. No.: 926,430

[22] Filed: Jul. 20, 1978

Related U.S. Application Data

[63] Continuation of Ser. No. 763,307, Jan. 28, 1977, abandoned.

[51] Int. Cl.[2] ..... G03G 15/00

[52] U.S. Cl. ..... 355/3 DD; 118/653; 427/18; 427/20; 427/21

[58] Field of Search ..... 355/3 DD; 118/653-658; 427/18, 20, 21

[56] References Cited

U.S. PATENT DOCUMENTS

| | | | |
|---|---|---|---|
| 3,542,579 | 11/1970 | Gundlach | 427/20 |
| 3,880,119 | 4/1975 | Fraser | 118/655 X |
| 3,900,255 | 8/1975 | Yamamoto | 355/3 DD |
| 3,918,402 | 11/1975 | Ohta | 427/18 X |
| 3,921,578 | 11/1975 | Genthe et al. | 118/654 X |

*Primary Examiner*—R. L. Moses

*Attorney, Agent, or Firm*—Carl Fissell, Jr.; Robert L. Kaner; Kevin R. Peterson

[57] ABSTRACT

A development apparatus for dry toning a latent, electrostatic image on a dielectric surface. The developing apparatus includes a rotating, magnetic brush which picks up dry toner from a reservoir and magnetically carries it past a first region on the dielectric surface to allow it to electrostatically adhere thereto. Residual toner carried past the first region is picked up by an impeller that impels the toner toward a second region on the dielectric surface to simulate cascade toning. Finally, toner that centrifugally escapes the magnetic brush effuses outwardly and is guided toward a third region on the dielectric surface to form a toner cloud.

14 Claims, 4 Drawing Figures

METHOD AND APPARATUS FOR DEVELOPING A LATENT, ELECTROSTATIC IMAGE IN NON-IMPACT PRINTING

This is a continuation, of application Ser. No. 763,307, filed Jan. 28, 1977 now abandoned.

INTRODUCTION

This invention relates to non-impact printers of the class which form a latent electrostatic image of a document and develop the image by the application of dry particle toner.

BACKGROUND OF THE INVENTION

There are three well known techniques for dry particle development of a latent, electrostatic image in a non-impact printing device: cascade, magnetic brush and cloud application. In each technique a mix of toner particles, typically formed of ferromagnetic carrier granules that are triboelectrically coupled to carbon-impregnated resin particles, is applied to the latent, electrostatic image. As the toner mix approaches the electrostatic image, the coulomb attraction between the carbon-impregnated resin particles and image overtakes the triboelectrical coupling between the carrier granules and resin particles and causes the carbon-impregnated resin (or similar pigment) to adhere to the image, thus the image is developed. Each technique has advantages and disadvantages which require tradeoffs between speed and performance, as will be discussed presently.

The cascade technique of toner application involves dispensing toner from a bucket or other like container and allowing it to fall under gravitational influence onto the dielectric surface bearing the latent electrostatic image. Commonly, the dispensing container is one of a plurality of such containers arranged in conveyor-like fashion on an endless chain or belt.

The cascade technique is limited in the speed at which it can feed toner to the latent electrostatic image. Specifically, the cascade technique generally employs a complex mechanical movement to transport toner from a source to the dispensing station; e.g. a conveyor of buckets. Moreover, the cascade development technique needs a developing electrode to develop a large solid area. The developing electrode has to be fairly close to the dielectric surface, hence it limits the flow rate of toner particles, therefore limiting the toner speed.

The cascade technique does, have an advantage if the electric field associated with the latent image is weak. In those instances the cascade technique imparts adequate kinetic energy to the triboelectrically coupled toner components to allow them to break free of their mutual attraction when they impact the dielectric surface supporting the latent electrostatic image. As a result, there is an abundance of free resin (or other type pigment) particles to couple a weak latent electrostatic image.

The magnetic brush technique typically employs a cylindrical drum or roller which has a permanent magnet disposed within it. Through each rotation of the drum or roller, toner particles are picked up through the magnetic field associated with the magnet and transported to the dielectric surface supporting the latent, electrostatic image. The magnetic brush technique has the advantage of speed, but also has the disadvantage of imparting little kinetic energy to the triboelectrically coupled particles and requires a relatively strong electrostatic image to assure quality image development.

The cloud technique involves the formation of a cloud-like distribution of toner mix in the area of the dielectric surface supporting the electrostatic image. The cloud technique is suitable for the development of extremely weak latent electrostatic images. The drawback, however, is that resin particles may come to rest on the dielectric surface in uncharged areas causing unwanted spots on the background of the transferred image.

This review of the prior art points out the need for a toning device that provides high speed development, accommodates weak latent, electrostatic images and otherwise avoids limitations attendant to the prior art.

BRIEF SUMMARY OF THE INVENTION

The present invention is a high speed toning device that incorporates the cascade, magnetic brush and cloud development techniques in a complemental manner that utilizes their advantages and offsets their disadvantages.

The developing apparatus that effects these combined techniques broadly comprises a magnetic brush, an impeller which coacts with the brush to simulate cascade toning, and a curvilinear guide to receive toner particles that centrifugally escape the magnetic brush and guide them into a cloud formation. Specifically, toner is picked up from a source by the magnetic brush and supported in its magnetic field for rotational transport to a first region on the dielectric surface. Residual toner that is transported beyond the first region is picked up by the impeller and impelled toward a second region on the dielectric surface to simulate cascade toning. Toner particles that centrifugally escape the field of the magnetic brush and are not picked up by the impeller are guided toward a third region on the dielectric surface to form a toner cloud adjacent thereto.

The invention will be further appreciated by reference to the following detailed description of a specific embodiment which is to be taken in conjunction with the drawing.

DETAILED DESCRIPTION OF A SPECIFIC EMBODIMENT

Figure 1:
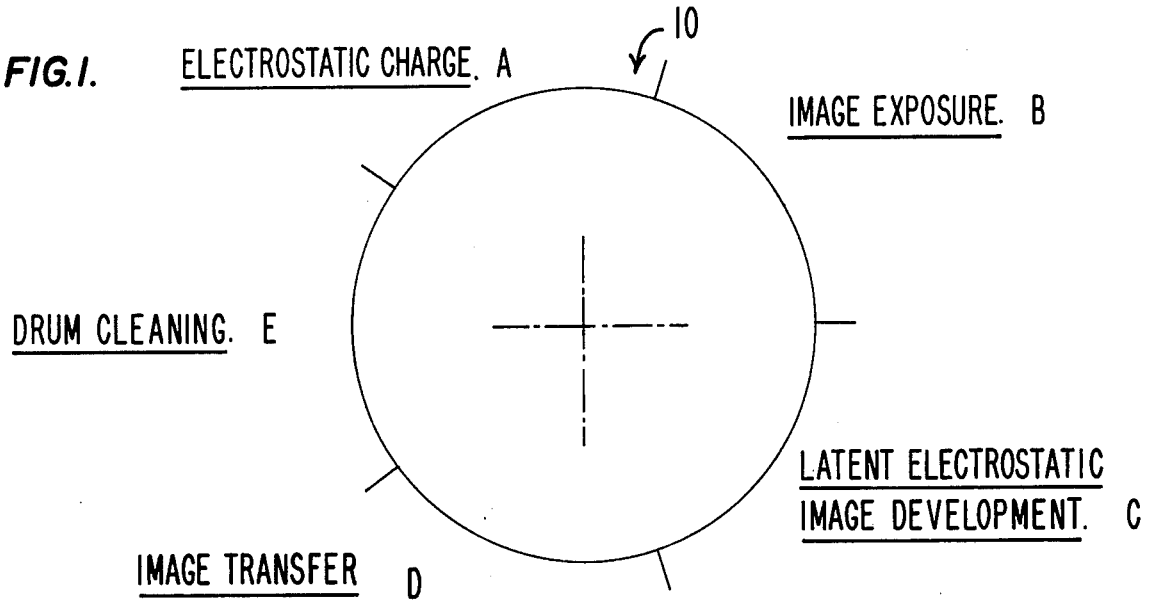
FIG. 1 is a diagrammatic representation of the sequence of steps involved in non-impact printing.

FIG. 1 is representative of the various stages involved in a conventional non-impact printing process. A rotational printing drum, shown generally at 10, is divided into five parts to illustrate the five basic steps involved. They are briefly described as follows.

In arcuate region A an electrostatic charge is uniformly deposited on the surface of the drum 10. This may be accomplished by a corona discharge device or the like as is known in the art.

In region B the image which is to be reproduced is exposed onto the drum to form a latent electrostatic image. In typical embodiments, the outer periphery of the drum 10 is coated with a thin photoconductor. When the photoconductive surface is energized by light it becomes conductive and discharges any electrostatic charge deposited on it. Accordingly, when the image is projected onto the photoconductive surface, areas that are exposed to light will discharge and areas that do not receive light will remain charged. This effectively creates an electrostatic representation of the image.

In region C, the latent electrostatic image is developed by the application of toner material. When the toner material is applied it adheres to the electrostatic charge representing the image and brings it into development. This brief description of the development process will presently be set forth in much greater detail.

In region D, the developed image is transferred onto a record medium by a corona unit and the toner image on the record medium is fixed by heat fusion to render a permanent record.

In region E, the drum is cleaned for removal of any residual toner that may have not been transferred in the preceding step. At this point the printing cycle is complete.

Figure 2:
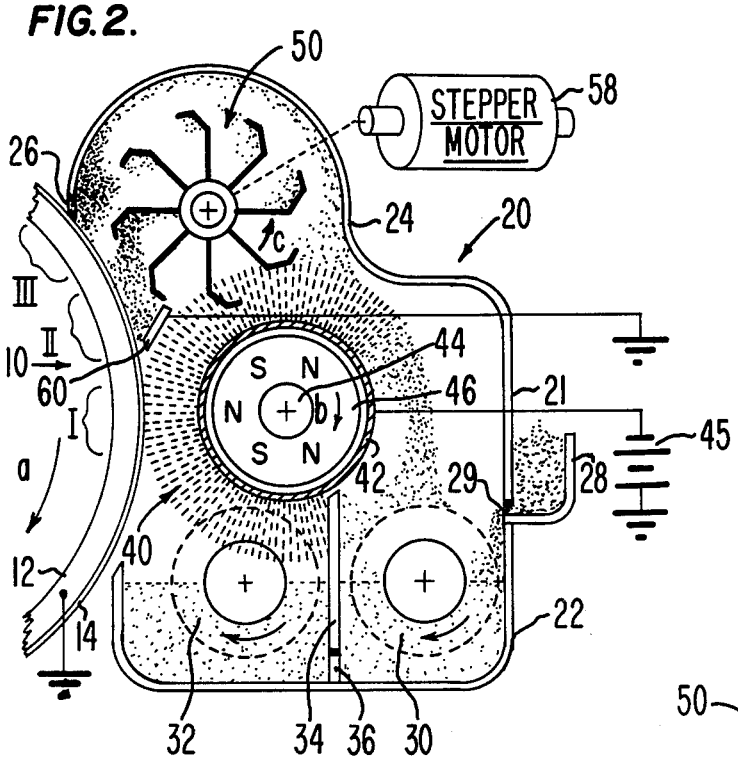
FIG. 2 is a view of apparatus for performing the latent electrostatic image development step of FIG. 1.

With reference to FIG. 2, the apparatus for performing the latent, electrostatic image development, shown as arcuate sector C in FIG. 1, is shown in greater detail. A drum 10 is mounted on a central hub (not shown) for rotation in the direction of arrow a. The outer periphery of the drum comprises a rim 12 formed of aluminum or other lightweight, conductive material. The outer surface of the rim 12 is coated with a photoconductive material 14 which becomes electrically conductive when exposed to incident light energy in the manner previously discussed. The rim 12 is grounded to provide a conductive path when exposed areas on the photoconductive surface 14 discharge.

An image development apparatus, shown generally at 20, is disposed adjacent the drum 10. The development apparatus 20 includes an outer body or housing 21 which has a lower reservoir portion 22 and an upper, curvilinear hood portion 24. At the leftmost extreme of the hood portion 24 is a sealing member 26 that is preferably formed of fur or other non-abrasive material to prevent the leakage of toner particles from between the drum 10 and hood 24.

The present invention contemplates the use of dry particle toner material made up of carrier granules that are triboelectrically coupled to pigment particles. The carrier granules are typically formed of iron so as to have ferromagnetic properties for reasons that will become evident. The toner pigment particles may be carbon-impregnated resin or the like. When the carrier granules and toner pigment particles are mixed with one another to form the toner material, they are triboelectrically charged frictional contact, the carrier granules being negatively charged and the pigment particles being positively charged. When the coupled carrier granules and pigment particles are brought into proximity to the latent, electrostatic image, the electrostatic attraction between the image and the pigment particles exceeds that of the attraction between the carrier granules and the pigment particle and causes the pigment particles to adhere to the latent, electrostatic image. The carrier granules once freed from the pigment particles may be recycled upon being mixed with a fresh supply of pigment particles.

In developing apparatus 20 a quantity of carrier granules is contained in the lower reservoir 22. Pigment particles are supplied through a hopper 28 and pass through a metering port 29 that communicates the hopper with the lower reservoir 22. The carrier granules and pigment particles are mixed by the rotational motion of a mixing auger 30 disposed in the right side of the lower reservoir 22. The lower reservoir is divided into two sections by a dividing wall 34. At the bottom of each end of the dividing wall 34 is an aperture 36 which allows the passage of the mixed toner material therethrough to communicate the right and left halves of the lower reservoir.

In the left half of the reservoir 22 is a feed auger 32. The feed auger picks up the mixed toner material as it rotates and carries it upwardly into the influence of a magnetic field where it is picked up by a magnetic brush, shown generally at 40. Mixing auger 30 and feed auger 32 are commercially available products obtainable from Feed Screws Division, NCI Incorporated, 420 Cascade Street, New Castle, Pennsylvania 16101.

The magnetic brush 40 picks up toner material through its magnetic field and rotationally transports it past the region on the drum indicated by I to effect toning in that region. The brush 40 basically comprises a cylindrical assembly having an axial length coextensive with the drum 10. An outer rim, 42, preferably formed of aluminum, is mounted for rotation on a central hub 44. A permanently magnetized collar 46 is supported on hub 44 but is freely seated so as to remain in fixed position as hub 44 rotates. The collar 46 is similarly coextensive with the axial length of the drum 10. A slight bias potential is applied to the brush 40 by a source 45 to pick up pigment particles that alight on the drum 10 by other than electrostatic attraction, as is a common occurrence with cloud toning.

Figure 3:
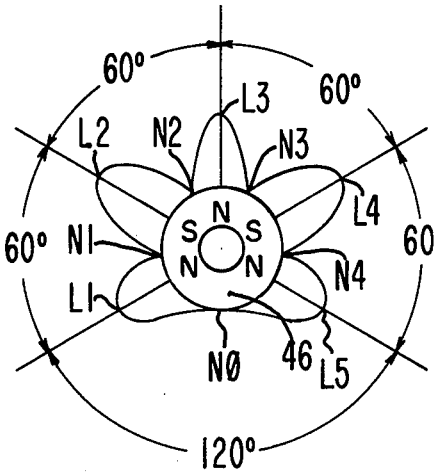
FIG. 3 is a view of the magnetic pole arrangement of the magnetic brush of FIG. 2.

Viewing FIG. 3, the permanently magnetized collar 46 is shown apart from the magnetic brush 40 to illustrate the magnetic field pattern associated with it. The collar has five magnetic poles asymmetrically distributed about the collar. Each pole has associated with it a loop point representing the maximum magnetic field intensity, as shown by L1, L2, L3, L4, and L5. Intermediate each pole is a nodal point as represented by N1, N2, N3 and N4. The poles are spaced 60° apart from one another with a 120° arcuate interval being without a pole. At the center of the 120° interval is a nodal point indicated by N$\phi$. The advantage of using an asymmetrical pole design will become apparent presently. A magnetic brush having the asymmetrical pole distribution utilized herein is commercially available from Hitachi Magnetics Corp., Edmore, Michigan 48829.

Referring again to FIG. 2, it can be seen that the permanently magnetized collar 46 is arranged on the hub 44 such that the nodal region that was represented by N$\phi$ in FIG. 3 is positioned distant from the drum 10. In this region the magnetic field is relatively weak and unable to support the transport of toner material. Therefore, in this region the toner material becomes free of the influence of the magnetic field and falls downwardly into the right portion of the lower reservoir 22. The falling toner material is relatively lean of pigment particles, being primarily made up of carrier granules from which pigment particles have been separated and applied to the latent, electrostatic image. In the lower right portion of the reservoir 22 the recycled carrier granules are mixed with a fresh supply of pigment particles fed in from hopper 28.

An impeller 50 is positioned above and leftward of the magnetic brush 40 and within the boundary defined by the curvilinear hood 24. The impeller 50 is driven by a stepper motor 58 in the direction of arrow c to create a pulse-like rotational motion for purposes that will be hereinafter discussed.

Figure 4:
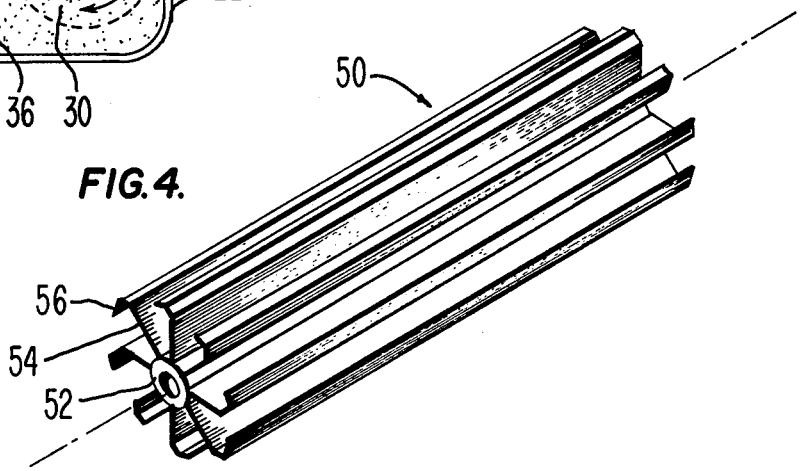
FIG. 4 is a perspective view of the impeller of FIG. 2.

Viewing particularly FIG. 4, the impeller 50 comprises a central shaft 52 having a plurality of symmetrically disposed vanes or blades 54 directed radially outward therefrom. Each vane 54 terminates in a tangential lip 56 formed by twice bending the outermost portion of the vane. The impeller 50 is preferably of aluminum construction.

The impeller 50 is positioned sufficiently close to the magnetic brush 40 to allow it to pick up residual toner material transported beyond the drum 10 in region I. The toner material is effectively scooped up by the rotating vanes 54 and carried around. When each vane is at approximately 45° in the lower left quadrant, the combined action of gravitational and centrifugal forces cause the toner material to escape the containment of the lip 56 and cascade down toward the drum 10 in the region indicated by II so as to simulate cascade toning in the region. The stepper motor 58 imparts a pulse-like effect which facilitates the release of toner material from each vane 54 as it comes into position above region II. A grounded developing electrode 60 may be provided to regulate the application of toning material onto region II and also serve to equalize the electrical field intensity over charged areas on the latent, electrostatic image as is well known in the art.

The developing apparatus 20 further provides toning by the cloud technique in the region on the drum 10 indicated by III. A particle cloud of toner material is formed when toner material centrifugally escapes the magnetic field of the brush 40 and effuses outwardly. The outward effusion of toner material is channeled or guided by the curvilinear hood 24 around the interior of the hood toward region III on the drum. Toner flow is assisted by the vortex-like flow created by the rotational motion of the impeller 50. Consequently, a satisfactory amount of toner material is guided through the space between the extreme ends of the vanes 54 of the impeller 50 and the interior wall of the curvilinear hood 24 to form a toner cloud adjacent region III.

In summary, the developing apparatus 20 of the present invention effectively combines the magnetic brush, cascade and cloud techniques to develop a latent, electrostatic image for non-impact printing. Toner material is first applied by a magnetic brush 40 on the drum 10 in region I. The impeller 50 picks up toner material carried by the magnetic brush beyond region I and rotationally transports it to region II on the drum 10 where it cascades downwardly. The cloud technique is accomplished by channeling toner material which centrifugally escapes the magnetic field of the brush 40 through a guided path with the assistance of the vortex-like flow created by the impeller.

While the invention has been shown in a specific embodiment, the particular details hereinbefore set forth should not be deemed limiting. Varying embodiments of the invention will suggest themselves to persons with skill in the art without departing from the spirit and scope of the appended claims.

The embodiments of the invention in which an exclusive property or privilege is claimed are defined as follows:

1. In a non-impact printer of the class wherein a latent, electrostatic image is deposited on a dielectric surface for development prior to the transfer of the image onto a record medium, an improved developing apparatus comprising:

a source of particulate, ferromagnetic toner material;

magnetic brush means, in communication with said source, for receiving toner material from said source and rotationally transporting it past a first region on said dielectric surface to tone the latent, electrostatic image in the first region;

an impeller that rotates in circular motion about a single central axis thereof, said impeller for receiving residual toner material rotationally transported beyond the first region by said magnetic brush means and for impelling said received toner material toward a second region to tone the latent electrostatic image in the second region; and guide means that are curvilinear in shape, said guide means for guiding toner material centrifugally escaping said magnetic brush means toward a third region on said dielectric surface to form a toning cloud adjacent thereto to tone the latent electrostatic image in the third region, said guide means being located adjacent the rotating impeller so that the rotating impeller assists the guide means by creating a vortex flow to facilitate the flow to toner material through the guide means.

2. Apparatus for developing a latent, electrostatic image on a dielectric surface comprising:

a source of particulate, ferromagnetic toner material;

magnetic brush means, in communication with said source, for receiving toner material from said source and rotationally transporting it past a first region on said dielectric surface to tone the latent, electrostatic image in the first region;

an impeller that rotates in circular motion about a single central axis thereof, said impeller for receiving residual toner material rotationally transported beyond the first region by said magnetic brush means and for impelling said received toner material toward a second region to tone the latent, electrostatic image in the second region; and guide means that are curvilinear in shape, said guide means for guiding toner material centrifugally escaping said magnetic brush means toward a third region on said dielectric surface to form a toning cloud adjacent thereto to tone the latent, electrostatic image in the third region, said guide means being located adjacent the rotating impeller so that the rotating impeller assists the guide means by creating a vortex flow to facilitate the flow of toner material through the guide means.

3. The developing apparatus of claim 2 wherein said magnetic brush means comprises a cylindrical drum supported for rotation about an axis disposed in a plane parallel to said dielectric surface, and magnetic field means, interiorly disposed in said cylindrical drum, for providing a magnetic field to support the rotational transport of the ferromagnetic toner material.

4. The developing apparatus of claim 3 wherein said magnetic field associated with said magnetic field means is asymmetrical, having a nodal region on the side of the cylindrical drum opposite said dielectric surface.

5. The developing apparatus of claim 3 wherein said dielectric surface forms an arcuate portion of a rotating cylindrical drum and said magnetic brush drum rotates in the same direction as said dielectric surface drum such that adjacent points on said respective drums have tangential velocities in opposite directions.

6. The developing apparatus of claim 2 wherein said impeller comprises a shaft supported for rotation about an axis parallel to said dielectric surface, said shaft having a plurality of circumferentially distributed vanes formed thereon, each vane being disposed to be coplanar with the shaft axis.

7. The developing apparatus of claim 6 wherein each of said vanes is bent at its outermost edge to form a substantially tangential lip.

8. The developing apparatus of claim 6 wherein said impeller shaft is driven by a stepper motor.

9. The developing apparatus of claim 2 wherein said toner material comprises an admixture of carrier particles triboelectrically coupled to pigment particles.

10. The developing apparatus of claim 9 wherein said source is defined to include a reservoir for containing toner material and auger means, disposed within said reservoir, for mixing said carrier particles and pigment particles and feeding the admixture to said magnetic brush means.

11. The developing apparatus of claim 2 further comprising a developing electrode disposed adjacent the second region on said dielectric surface to regulate the application of toner to the second region and further to equalize the electrical field intensity over charged areas on the latent image.

12. The developing apparatus of claim 2 wherein said magnetic brush means is electrostatically biased to attract any toner material carried on said dielectric surface in positions not electrostatically charged.

13. A non-impact printer comprising:

a dielectric surface for supporting a latent, electrostatic image, image means for depositing a latent, electrostatic image on said dielectric surface;

image development means for developing the latent, electrostatic image on said dielectric surface, said image development means being defined to include, a source of particulate, ferromagnetic toner material, magnetic brush means in communication with said source, for receiving toner material from said source and rotationally transporting it past a first region on said dielectric surface to tone the latent, electrostatic image in the first region, an impeller that rotates in circular motion about a single central axis thereof, said impeller for receiving residual toner material rotationally transported beyond the first region by said magnetic brush means and for impelling said received toner material toward a second region to tone the latent electrostatic image in the second region, and guide means that are curvilinear in shape, said guide means for guiding toner material centrifugally escaping said magnetic brush means toward a third region on said dielectric surface to form a toning cloud adjacent thereto to tone the latent electrostatic image in the third region, said guide means being located adjacent the rotating impeller so that the rotating impeller assists the guide means by creating a vortex flow to facilitate the flow of toner material through the guide means.

14. A method for developing a latent, electrostatic image deposited on a dielectric surface comprising the steps of:

rotationally transporting ferromagnetic, particulate toner material in a magnetic field from a source of said material past a first region on said dielectric surface;

receiving toner material magnetically transported beyond the first region with an impeller that rotates in circular motion about a single central axis and impelling said received material toward a second region on said dielectric surface as said impeller rotates in circular motion; and guiding toner material centrifugally escaping the magnetic field toward a third region with a curvilinear shaped guide that is located adjacent the rotating impeller so that the rotating impeller assists the guiding by creating a vortex flow to facilitate the flow of toner material toward the third region on said dielectric surface to form a particulate cloud proximate the third region.

* * * * *